US006995676B2

(12) United States Patent
Amacher

(10) Patent No.: US 6,995,676 B2
(45) Date of Patent: Feb. 7, 2006

(54) MOISTURE DETECTION AND LOCATION SYSTEM

(76) Inventor: Mark Amacher, 113 Fallsbury Rd., Irmo, SC (US) 29063

( * ) Notice: Subject to any disclaimer, the term of this patent is extended or adjusted under 35 U.S.C. 154(b) by 72 days.

(21) Appl. No.: 10/156,741

(22) Filed: May 28, 2002

(65) Prior Publication Data

US 2003/0222783 A1 Dec. 4, 2003

(51) Int. Cl.
*G08B 21/00* (2006.01)

(52) U.S. Cl. ..... 340/602; 340/603; 340/604; 340/539.22; 73/40

(58) Field of Classification Search ..... 340/602, 340/604, 605, 618, 620, 627, 870.16, 870.06, 340/539.1, 539.22, 603; 73/40.5 R; 70/40
See application file for complete search history.

(56) References Cited

U.S. PATENT DOCUMENTS

| | | | | |
|---|---|---|---|---|
| 3,967,197 | A | | 6/1976 | Anderson |
| 4,197,866 | A | | 4/1980 | Neal |
| 4,227,190 | A | | 10/1980 | Kelley et al. |
| 4,246,575 | A | | 1/1981 | Purtell et al. |
| 4,259,633 | A | | 3/1981 | Rosenau |
| 4,264,901 | A | | 4/1981 | Petersen et al. |
| 4,264,902 | A | | 4/1981 | Miller |
| 4,502,044 | A | | 2/1985 | Farris et al. |
| 4,598,273 | A | | 7/1986 | Bryan, Jr. et al. |
| 4,892,113 | A | | 1/1990 | Fattahi |
| 4,965,554 | A | | 10/1990 | Darling |
| 5,008,652 | A | | 4/1991 | Woloszyk |
| 5,081,422 | A | | 1/1992 | Shih |
| 5,082,173 | A | | 1/1992 | Poehlman et al. |
| 5,106,339 | A | | 4/1992 | Braun et al. |
| 5,176,316 | A | | 1/1993 | Whitman |
| 5,337,957 | A | | 8/1994 | Olson |
| 5,546,009 | A | | 8/1996 | Raphael |
| 5,655,561 | A | * | 8/1997 | Wendel et al. ..... 137/79 |
| 5,730,024 | A | | 3/1998 | Sahlen |
| 5,748,092 | A | | 5/1998 | Arsenault et al. |
| 5,818,340 | A | | 10/1998 | Yankielun et al. |
| 5,881,951 | A | | 3/1999 | Carpenter |
| 5,886,636 | A | | 3/1999 | Toomey |
| 5,907,279 | A | * | 5/1999 | Bruins et al. ..... 340/506 |

OTHER PUBLICATIONS

"Improvements" Catalog, p. 54, "Water Leak Alarm" device, date unknown.

(Continued)

*Primary Examiner*—Davetta W. Goins

(57) ABSTRACT

A system is provided to monitor for moisture at separate locations interior to exterior structure cladding. The system includes a plurality of moisture sensors, at least one of which is disposed at each location to be monitored. Upon activation by the presence of moisture at its respective said location, the moisture sensor generates a signal. The system may also include a receiver in communication with the moisture sensors, to provide an identifier of the location of an activated moisture sensor. The moisture sensors and receiver may communicate via wiring, or wirelessly. The system so provided may be disposed within a single structure, or within a plurality of structures, with the receiver disposed within such a structure or remote to any such monitored structure.

30 Claims, 8 Drawing Sheets

U.S. PATENT DOCUMENTS 6,025,788 A * 2/2000 Diduck ..... 340/870.16
6,104,298 A 8/2000 Flanders
6,147,613 A 11/2000 Doumit
6,175,310 B1 1/2001 Gott
6,359,558 B1 * 3/2002 Tsui ..... 340/531
6,377,181 B1 * 4/2002 Kroll et al. ..... 340/604
6,489,895 B1 * 12/2002 Apelman ..... 340/605
6,552,647 B1 * 4/2003 Thiessen et al. ..... 340/3.1

OTHER PUBLICATIONS

A. TenWolde and G. E. Courville, Ph.D., "Instrument for Measuring Moisture in Building Envelopes", HI-85-22 No. 3, pp. 1101-1115, date unknown.

* cited by examiner

MOISTURE DETECTION AND LOCATION SYSTEM

FIELD OF THE INVENTION

The present invention relates to a monitoring system for detection and location of moisture at multiple, separate locations about structures. More specifically, the present invention provides a moisture detection and location system with multiple sensors that may be in communication with a receiver to provide an identifier of the location of detected moisture, and may be deployed in a single structure or multiple structures.

BACKGROUND OF THE INVENTION

Despite advancements in materials and techniques for constructing and fabricating structures, it has been found that unwanted moisture may nevertheless intrude into a structure.

A structure such as a residential or commercial building may be considered to have an exterior building envelope that includes the exterior cladding of the walls and the roof. The exterior wall cladding may be brick masonry veneer, synthetic or masonry stucco, fiberboard siding, or other materials, while the roof may include asphalt shingles, tiles, built-up plies, sheet metal panels, or other systems. Typically beneath the envelope material is a vapor barrier, such as felt paper, tar paper, plastic sheeting, or other material. Beneath the vapor barrier is typically sheathing. Such sheathing typically is attached to the structural frame, such as wood studs. These components, together, constitute the structure itself. Few of these components are visible once the structure is completed, as only the exterior cladding is presented to view. The exterior envelope is intended in part to protect the components defining the structure from the intrusion of moisture. However, moisture may nevertheless intrude beyond the envelope into the structure.

Structural moisture intrusion into the building envelope can be quite damaging. Even small moisture quantities that have intruded beyond the exterior cladding or roofing of a structure promote the development and progression of wood-destroying organisms, rust, or other destructive and detrimental processes. The troubles caused by moisture intrusion are often exacerbated because the moisture intrudes only to unseen, interior portions of the structure, such as the interior portions of exterior walls in a building, and it is there, undetected, that the destructive and detrimental processes develop and grow. The structural damage resulting from such processes often cannot be detected until such damage has progressed so far, for so long, that its destruction progresses beyond the unseen, interior portions of the structure into adjacent visible portions of the structure. Such destructive progression exacerbates both the degree of damage and the costs of repairs to the structure.

As an example of such harmful effects, it has been discovered that moisture intrusion into a building often occurs at penetrations to the exterior cladding of the building, such as windows, doors, exterior lighting fixtures, exterior electrical outlets, side ventilations from dryers, and the like. It has also been found that such moisture intrusion occurs at junctures between the plane of a building roof and the plane of a building wall, especially when, for architectural reasons, the lower edge of the roof terminates within the plane of an exterior wall, or at the intersection of dormer window structures with building roofing systems, or, for example, at the juncture of a chimney structure with a building roofing system.

As a further illustrative example, moisture intrusion has been found to be a problem with buildings clad in synthetic stucco. From the nature of the material itself, synthetic stucco provides a moisture-proof exterior cladding, and building wall surfaces clad in the material are intended to be optimally moisture-proof. However, at stucco building wall surface penetrations, including windows, doors, exterior electrical outlet penetrations, and the like, the juncture of the terminating edge of the synthetic stucco exterior cladding with the adjoining edge of the penetrating component is susceptible to the intrusion of moisture. Once moisture penetrates into a synthetic stucco cladding system and seeps or migrates beyond such a juncture, it cannot escape or evaporate, because the synthetic stucco that clads the building at such locations is moisture-proof and thereby prevents or inhibits escape of the moisture. Accordingly, the moisture is trapped inside the exterior cladding of the building and is left to promote the development of organisms that cause the decay of building components such as sheathing, structural studs, window and door framing, and the like. The exemplified problem, however, is not confined to buildings utilizing exterior synthetic stucco cladding, and indeed has been found to occur in buildings using masonry products such as brick veneer, buildings using wood siding, and in other buildings using different materials and techniques for exterior cladding.

The problem of detecting and locating the intrusion of moisture beyond the exterior cladding of a structure is quite difficult to solve. Any system for solving the problem must be easily installed, as it will be installed in the field by craftsmen who are often under time constraints for completion of such construction and are not in possession of specialized tools dedicated to installation of particularized individual components. Furthermore, the spaces provided in such structures for disposition of system detection and location components at locations susceptible to such moisture intrusion are quite small—for example, moisture can intrude at the juncture of a exterior building cladding system and a window frame, which involves the space of only a small fraction of an inch. Moreover, given the variety of designs employed in architectural and other structures, almost an infinite variety of different configurations of framing members, sheathing components, window designs, door configurations, flashing details, joining techniques, and the like must be anticipated, and any system for detecting and locating the penetration of moisture should be easily adaptable in the field to such a variety of configurations. Any such system also must be able to detect quite small quantities of moisture, as it has been found that even small quantities are nevertheless sufficient for the promotion and development of destructive processes, particularly considering that such small quantities may be located within the structural system at a location that does not allow for escape or evaporation.

Any system for solving the problem of detecting and locating the intrusion of moisture beyond the exterior cladding of a structure, however, must provide early detection, before the development and progression of destructive processes such as rot or rust, thereby minimizing repair costs to the structure. Moreover, the damaging effects of moisture intrusion into a structure is cumulative, such that earlier detection will allow the avoidance of the compounding effect of multiple, future intrusions. If detected early, preventive measures, such as caulking, adjustment of flashing, repair of roofing shingles, and the like, may be undertaken that will remediate the problem. However, visual detection often cannot be provided, because moisture intrusion often stops within walls, window systems, door systems, and so forth, and it is there that the rot or rust begins; such a system must provide for detection and location notwithstanding the absence of visual indicia of such moisture intrusion.

Additionally, such a system for detecting and locating the intrusion of moisture beyond the exterior cladding of a structure must be very durable, and should be expected to have a service lifetime exceeding the lifetime of the structure in which it is installed. Of course, any system for the detection of moisture also must be reliable, a quality promoted by greater simplicity in the design of such a system and its components. At the same time, though, such a system must require little to no maintenance, as it is the sense of security promoted by installation of such a system that is the motivation on the part of the responsible party for such installation, and many of such system components may be built into such a structure during original construction and will not thereafter be accessible for later service.

Finally, a system for the detection and location of moisture in a structural system must provide for relatively inexpensive components, as it will be recognized that even a relatively simple structure contains a relatively large number of locations susceptible to moisture intrusion, such as multiple doors, windows, and so forth in a building system.

The present invention relates to an innovation and improvement over and upon the known systems for detecting and locating the intrusion and moisture beyond the exterior cladding of a structure at multiple locations, and provides distinct advantages over the known systems.

BRIEF SUMMARY OF THE INVENTION

In response to the described difficulties, a new monitoring system for detection and location of moisture at multiple, separate locations about structures has been discovered. It is a principal object of the present invention to provide a moisture detection and location system with multiple sensors that may be in communication with a receiver to provide an identifier of the location of detected moisture, and may be deployed in a single structure or multiple structures. Additional objects and advantages of the invention will be set forth in part in the following description, or may be obvious from the description, or may be learned through practice of the invention.

In accordance with the invention, a system is provided for detection and location of moisture at multiple, separate locations about structures. The system may be utilized in any structure for which moisture monitoring at separate locations is desired, and may include a plurality of such structures.

The system includes a plurality of moisture sensors, with at least one moisture sensor being located at each location to be monitored for moisture. Such collection of sensors may be located within a single structure, or disposed about multiple structures. Each moisture sensor is activated upon the presence of moisture at the respective location of the sensor, causing the sensor to generate a signal. Such a signal may be an audible signal, a visual signal, or both an audible and visual signal from the sensor itself, or such a signal may be an electric signal or a wireless signal for receipt by other system components as will be described hereinbelow. In one embodiment, a moisture sensor may include at least two electrically conductive leads, located relative to each other so that moisture near or between the leads completes an electrical circuit. In such an embodiment, the leads may be configured in a nearly flat plane, so as to be capable of being attached in small or narrow spaces, and the leads may be carried by a pliable substrate, allowing the sensor to be conformed to the particular portion of the structure upon which it is attached.

The system may also include at least one receiver that is in communication with the moisture sensors, although more than one such receiver may be used at once, depending upon the requirements of the particular application. The receiver will provide a remote identification of the location of any moisture sensor that becomes activated by the presence of moisture. Such identification may be by an audible identifying alarm, or by a visual identifier such as a visual display panel. Such a receiver may be located within a single structure being monitored for moisture, may be located within one of several structures when the system is used in a plurality of structures, or may be remote to any and all structures being monitored for moisture.

Communication from the moisture sensors to the receiver may be accomplished by wire connections from each sensor to the receiver. Alternatively or additionally, each sensor may be in wireless communication with the receiver, such as by radio wave or by ultrasonic signal. Such communication occurs upon activation of any moisture sensor by liquid, so as to provide detection and location of moisture in the monitored structure at particular locations. With such communication, the location of the moisture may be discovered and located.

Some embodiments of the system may also include a central signal collector, located remote from the monitored structure, for receipt of a signal from any receiver included in the monitored system upon the detection of intruding moisture. Communication from such receivers to such a central signal collector may be by wireless or wired connection.

A system in accordance with the invention may be used in any application in which it is desired to detect and locate moisture at multiple, separate locations, such as buildings, water-going vessels, underground shafts and passages, and the like. In one exemplary embodiment, a residential housing structure or commercial building structure may be monitored for moisture. In such an embodiment, individual moisture sensors are placed at multiple locations suspected to be susceptible to moisture intrusion, including doors, windows, chimney-roof junctions, ventilation and plumbing component penetrations through the roof, shower room drain pans, built-in bathtubs, and exterior electrical component penetrations such as lighting fixtures and electrical outlets.

Early knowledge of moisture intrusion at a location is desirable, before resulting damage occurs and advances, but such locations cannot be monitored by simple visual observation absent invasive and destructive techniques. With the present system, sensors may be placed at such locations either during initial construction, or through post-construction retrofitting. In an exemplary embodiment, a receiver may also be located within the building, in communication with each moisture sensor. Upon the penetration of moisture beyond the exterior cladding or roofing of the building, a sensor detects the moisture and communicates its respective signal to the receiver, at which the presence and location of the moisture may then be learned. Such a system may also include the ability for further communication of such information to a remote central signal collector, for off-site monitoring of the structure by other parties or service providers.

These and other features, aspects, and advantages of the present invention will be better understood with reference to the following description and appended claims. The appended drawings, which are incorporated in and constitute a part of the specification, illustrate exemplary embodiments of the invention and, together with a description, serve to explain the principles of the invention.

DETAILED DESCRIPTION

Figure 1:
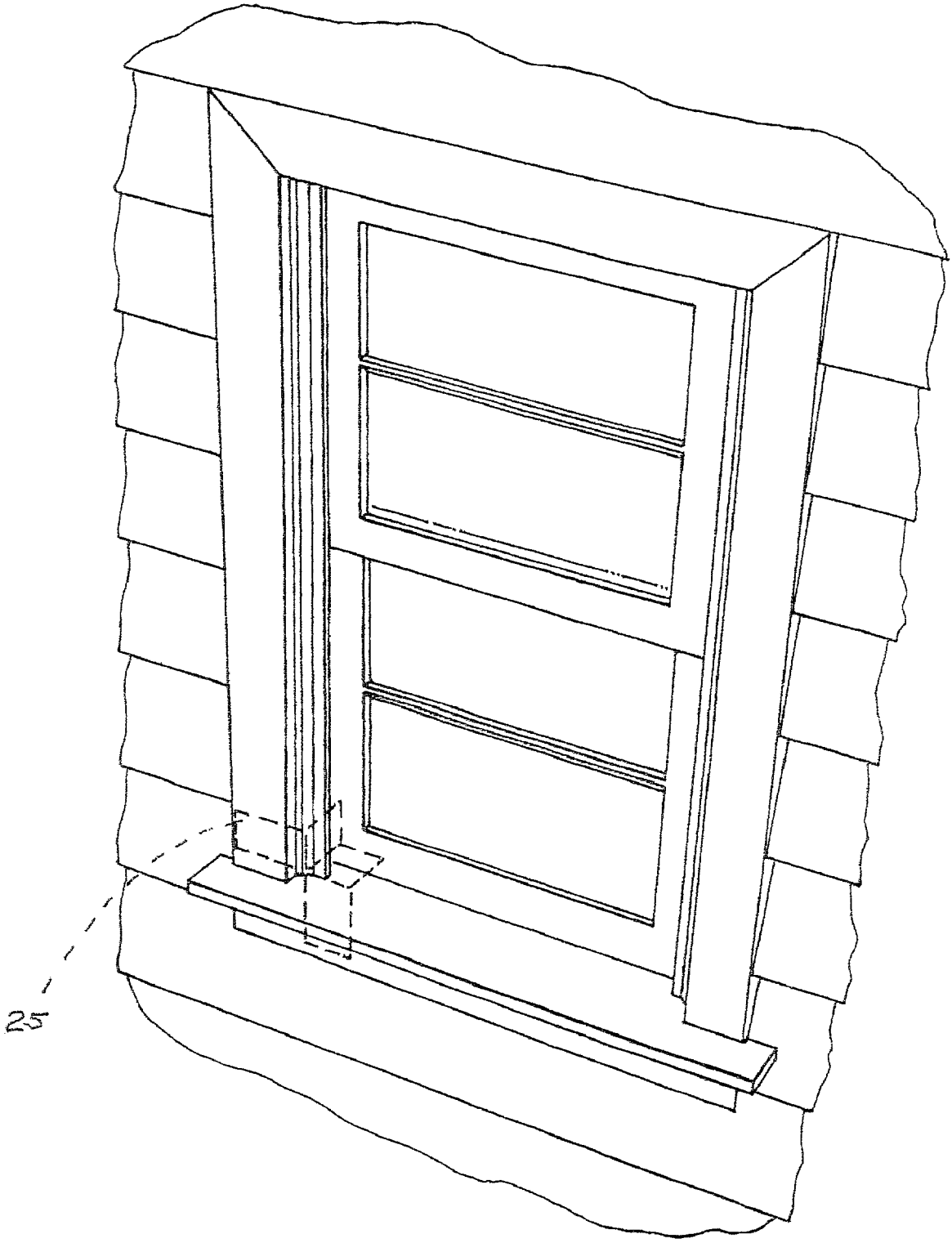
FIG. 1 is a perspective view of an embodiment of a moisture sensor installed at a window of a building.

Reference now will be made in detail to the presently preferred embodiments of the invention, one or more examples of which are illustrated the drawings. Each example is provided by way of explanation of the invention, and is not meant as a limitation of the invention. For example, features illustrated or described as part of one embodiment can be used on another embodiment to yield yet another embodiment. It is intended that the present application includes such modifications and variations as come within the scope and spirit of the invention.

The same numerals are used to refer to the same features throughout the drawings and the text that follows.

Referring to the appended Figures in general, a system 20, particularly a moisture detection and location system, according to the invention is illustrated. System 20 is not limited in its field of use, and has usefulness in any environment in which it is desired to separately detect and locate moisture at a plurality of locations 30. While the illustrated embodiment is depicted as used both in a residential housing structure and in a commercial building structure, system 20 may be used, for example, in the hulls and structures of water-going vessels, in the walls and encasements of underground tunnels and passageways, in interior monitoring stations for dams and other water impounding structures, and in other fabricated constructions about which the presence of water at any of a plurality of locations may be of significance.

In the illustrated embodiment, the system 20 includes a plurality of moisture sensors 25 disposed at a plurality of locations 30, each location 30 having at least one moisture sensor 25. Each moisture sensor 25 is activated upon the presence of moisture at its respective location 30, and generates a signal upon its activation. In the illustrated embodiment, each moisture sensor 25 includes at least two electrically conductive leads 40A and 40B. The leads 40A and 40B may be disposed in any number of different configurations relative to each other, but in the illustrated embodiment the leads 40A and 40B are elongated members generally parallel to each other. It will be appreciated that the leads 40A and 40B are disposed relative to each other such that moisture between them at any location along their length will complete an electrical circuit. The relative location of the leads 40A and 40B may depend on the particular environment in which the moisture sensor 25 is to be located. The completion of such an electrical circuit as in the exemplified embodiment generates a signal, as will be further discussed hereinbelow.

Figure 2:
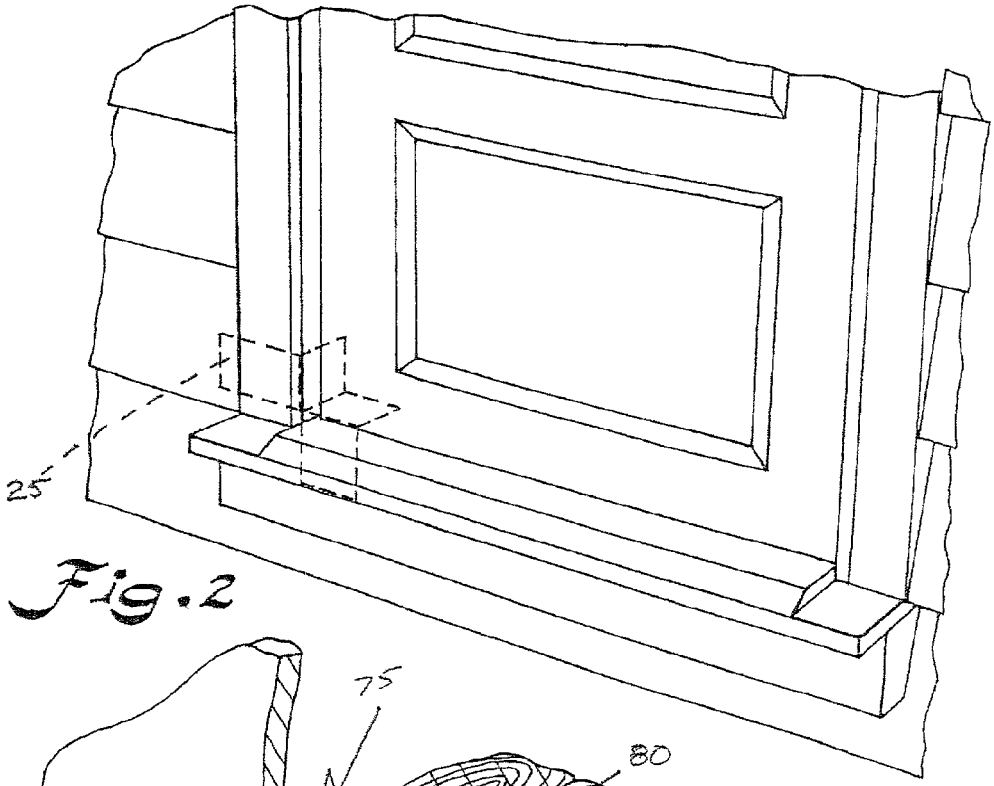
FIG. 2 is a perspective view of an embodiment of a moisture sensor installed at a door threshold.
Figure 4:
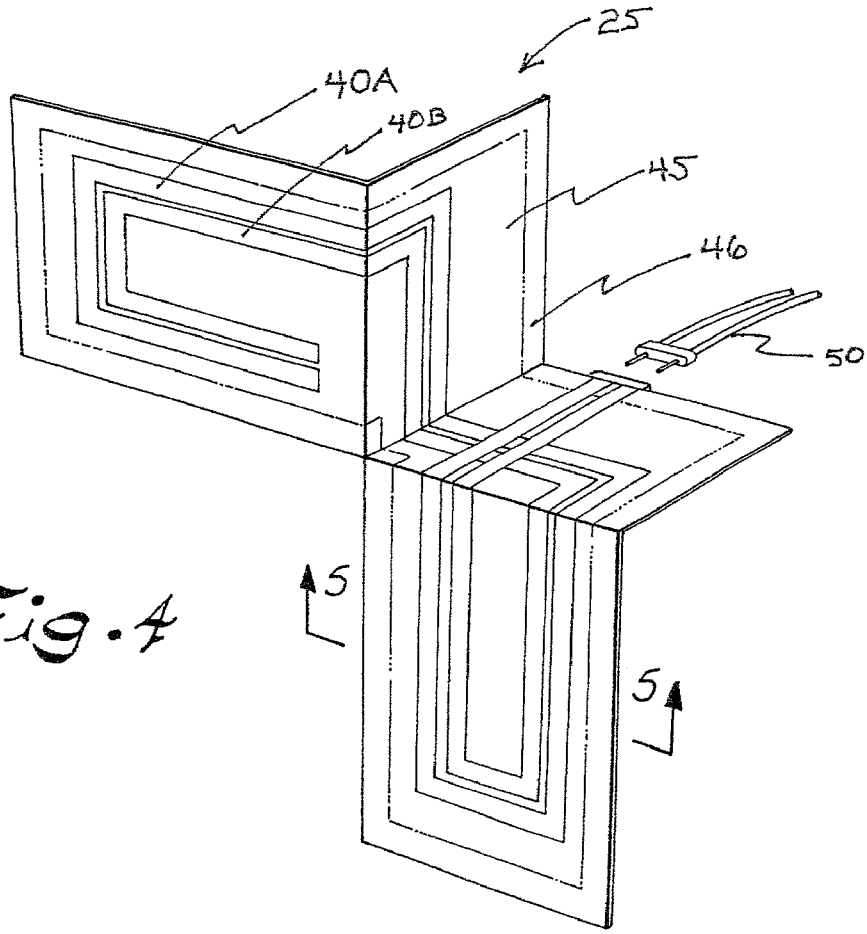
FIG. 4 is a perspective view of an embodiment of a moisture sensor.
Figure 5:
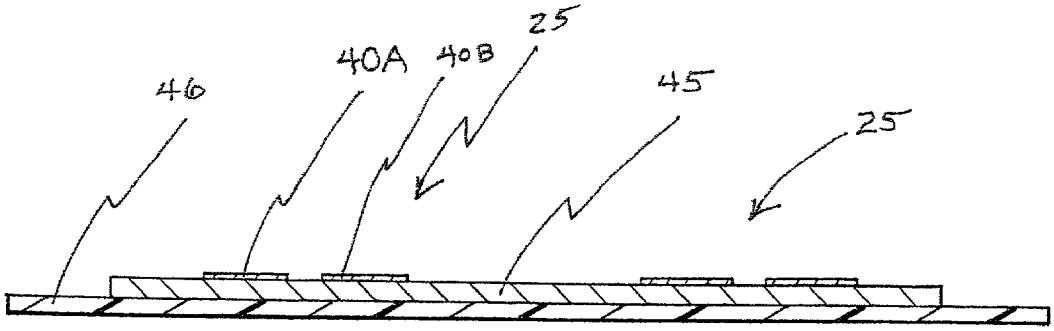
FIG. 5 is a cross-sectional view illustrating an embodiment of a moisture sensor.
Figure 6:
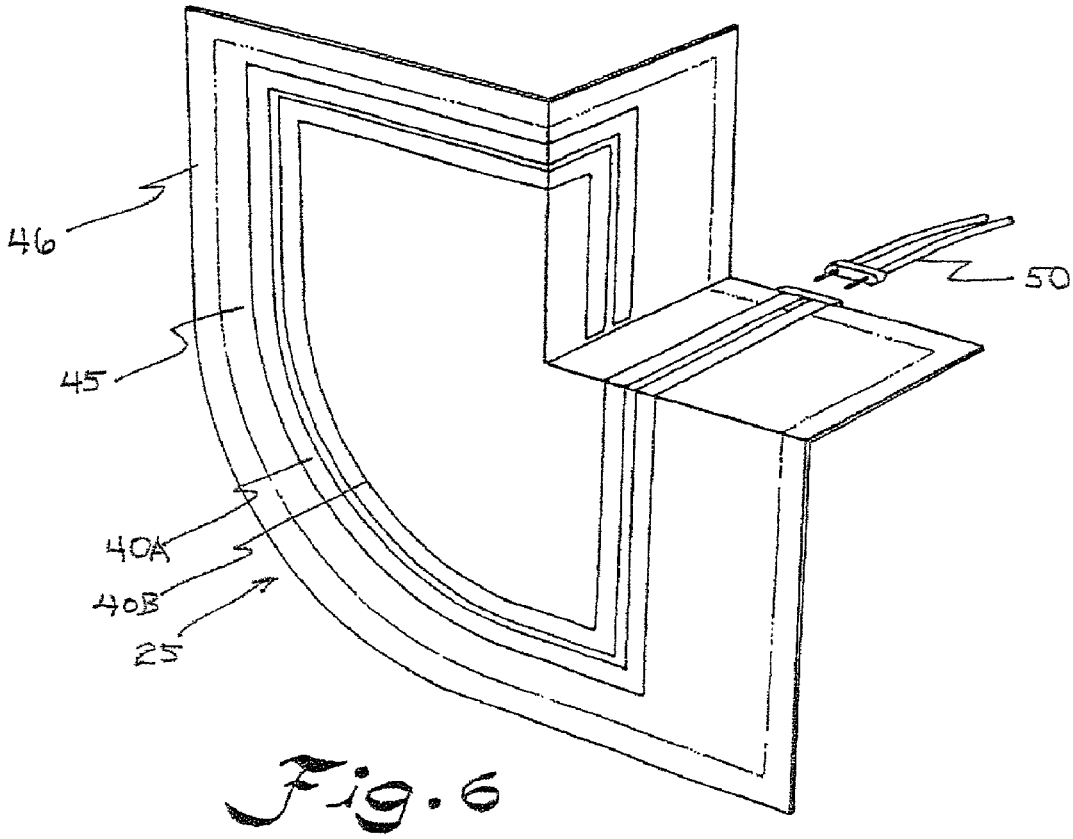
FIG. 6 is a perspective view of an embodiment of a moisture sensor with wire connection.
Figure 7:
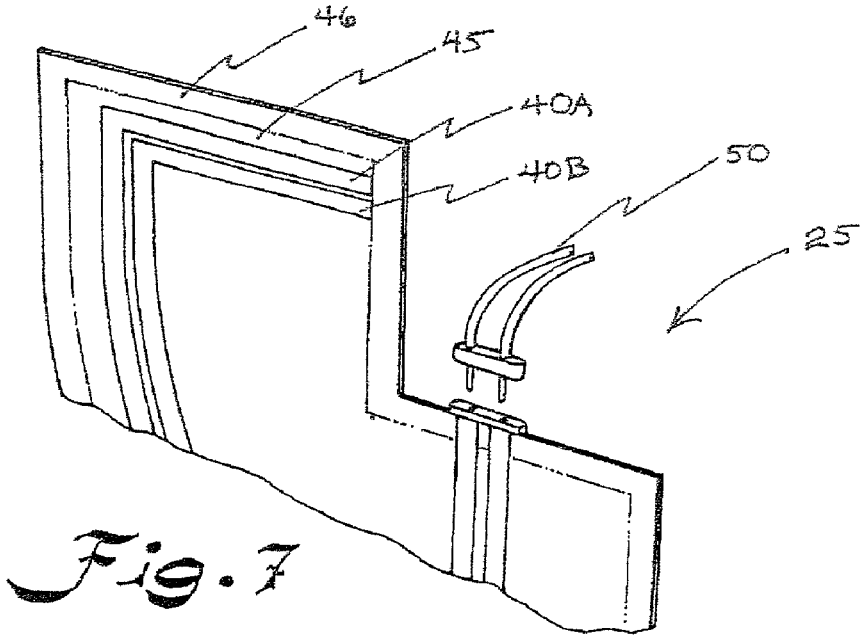
FIG. 7 is a different perspective view of an embodiment of a moisture sensor with a different wire connection.

The illustrated embodiment of the moisture sensors 25, as depicted for example in FIGS. 4, 5, and 6, further includes a pliable substrate 45 that is conformable to the shape and configuration of the structure upon which each moisture sensor 25 is attached, such that the moisture sensors 25 may be applied and used in the field regardless of the particular structural environment at hand, and conformed to the individual geometry of the environment so as to position leads 40A and 40B that moisture at a location 30 may be detected in the future. For example, a particular moisture sensor may be used within the framing of a window unit to a residential housing structure, as illustrated in FIG. 1, or at the threshold of a door to a residential housing structure or commercial building, as illustrated in FIG. 2. Variations in the shape and smoothness of the construction members (studs, sheathing, and the like) can be accounted for by the conformability of the moisture sensor 25 provided by the pliable substrate 45. The illustrated embodiment may also include a pliable attachment base 46, to allow for ease and speed of application of each moisture sensor 25 during construction or retrofitting of the system 20. The base 46 and the leads 40A and 40B may be configured in a variety of shapes, depending on the particular location in which the moisture sensor 25 is to be used. FIG. 4 illustrates a configuration with quadrilateral wings, while FIG. 6 illustrates a configuration with a radiused portion. The base 46 may also be configured in a ring-like shape (not shown), for use of the moisture sensor 25 around dryer vent pipe penetrations and the like. Either or both of the pliable substrate 45 and the pliable attachment base 46 may be perforated, so as to allow for the migration of moisture to the proximity of the leads 40A and 40B, or either or both of the pliable substrate 45 and the pliable attachment base 46 may be nonperforated, depending upon the requirements of the particular locations to be monitored.

As depicted in FIGS. 4 and 6, different shapes and geometries of the moisture sensors 25 may be used for different applications, depending upon the expected path and location of moisture that may intrude to within a structure in a particular application, or other requirements of such an application. Flat moisture sensors (not depicted) may be used in planar locations, such as adjacent to roof penetrations, while foldable moisture sensors might be necessary at locations such as windows and doors, as in FIGS. 1 and 2, respectively. Additionally, curvilinear moisture sensors (not depicted) may be used in applications such as round or oval windows.

Figure 3:
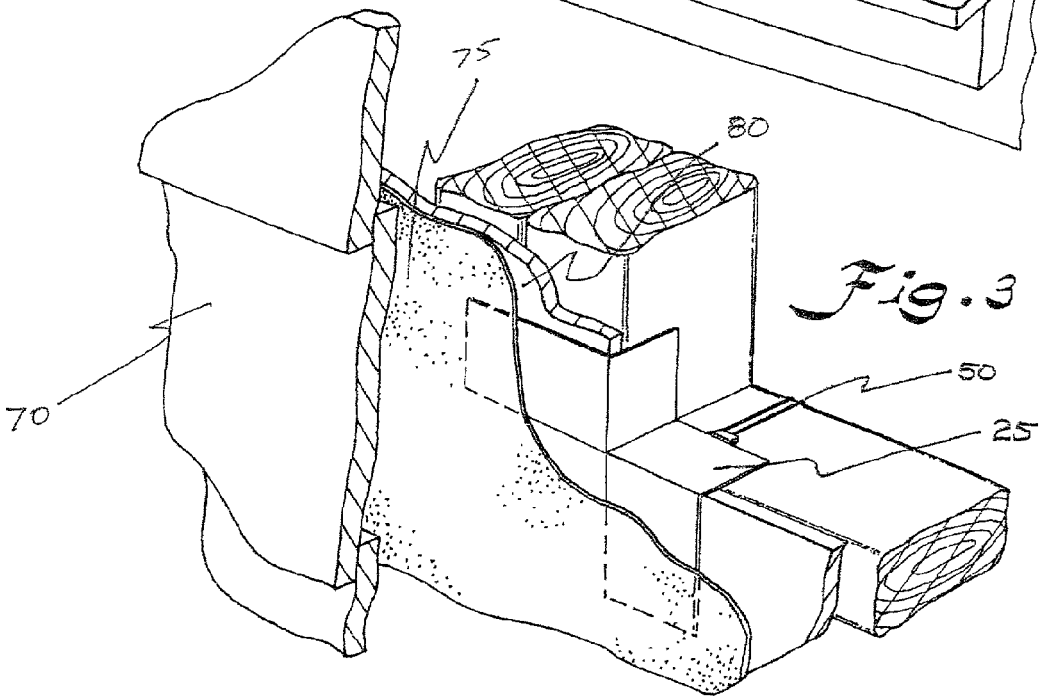
FIG. 3 is a perspective view, with portions removed for purpose of illustration, of an embodiment of a moisture sensor installed at the junction of structural framing members.

In one of the illustrated embodiments, depicted in FIG. 3 as a moisture sensor 25 used in a residential housing structure or commercial building structure, it has been found especially advantageous to position such a moisture sensor 25 interior to the exterior cladding 70 of the structure, and interior to the vapor barrier material 75, but exterior to the building sheathing 80, such positioning allowing for early detection of any moisture intruding beyond the exterior cladding 70 and the vapor barrier material 75.

It will be appreciated that the aforedescribed exemplary embodiment is provided only by way of illustration. The moisture sensors 25 may, in other embodiments, include any nature of moisture detection circuitry, including density variation detectors, electrical capacitance detectors, piezoelectric devices, magnetic resonance detection devices, and the like, depending upon the particular demands of the environment in which such sensors are to be deployed.

As aforementioned, the moisture sensors 25 generate a signal upon activation of the sensors 25 by moisture. Such a signal may be an audible signal from the sensor itself, to signify the detection of moisture at a particular location and to allow the location of such moisture, and corresponding audible signal, to be discerned. Such a signal may also be visual, such as by way of a light bulb or light emitting diode in electrical connection with the sensor, which likewise would signify the detection of moisture at a particular location and to allow the location of such moisture to be discerned. Some, if not all, of the moisture sensors 25 used in the system 20 may be hidden from normal view, absent destructive sampling to the structure in which the system 20 is used, so provision of an audible, visual, or other detectable signal by the moisture sensors 25 has been found to be useful in such a system 20. Such a signal may likewise be communicated to one or more receivers, as will now be described.

The system 20 may also include one or more receivers 35 for receipt of the signal generated by any one or more of the moisture sensors 25. Each sensor 25 is in communication with at least one receiver 35. More than one such receiver may be used at once, depending upon the requirements of the particular application. The receiver 35 will provide a remote identification of the location of any moisture sensor 25 that becomes activated by the presence of moisture at its respective location 30. Such identification may be by an audible identifying alarm, or by a visual identifier such as a visual display panel. For example, a receiver 35 may include a display panel with LCD indicators capable of revealing particular activated moisture sensors 25, or may have a bank of light emitting diodes, each dedicated to a particular moisture sensor 25. A receiver 35 may be located within a single structure being monitored for moisture, may be located within one of several structures when the system is used in a plurality of structures, or may be remote to any and all structures being monitored for moisture.

If a receiver 35 is used in a particular application of the system 20, communication from the moisture sensors 25 to the receiver 35 may be accomplished by wire connections 50 from each sensor to the receiver. Alternatively or additionally, each sensor may be in wireless communication (not depicted) to the receiver, such as by radio wave, ultrasonic signal, or the like, generated by each moisture sensor 25 for receipt of the receiver 35. Such communication occurs upon activation of any moisture sensor 25 by liquid or moisture at a particular location 30, so as to provide for the detection and locating of moisture in the monitored structure at particular locations 30. Other methods of communication between the moisture sensors 25 and the receiver 35 may be utilized.

Figure 8:
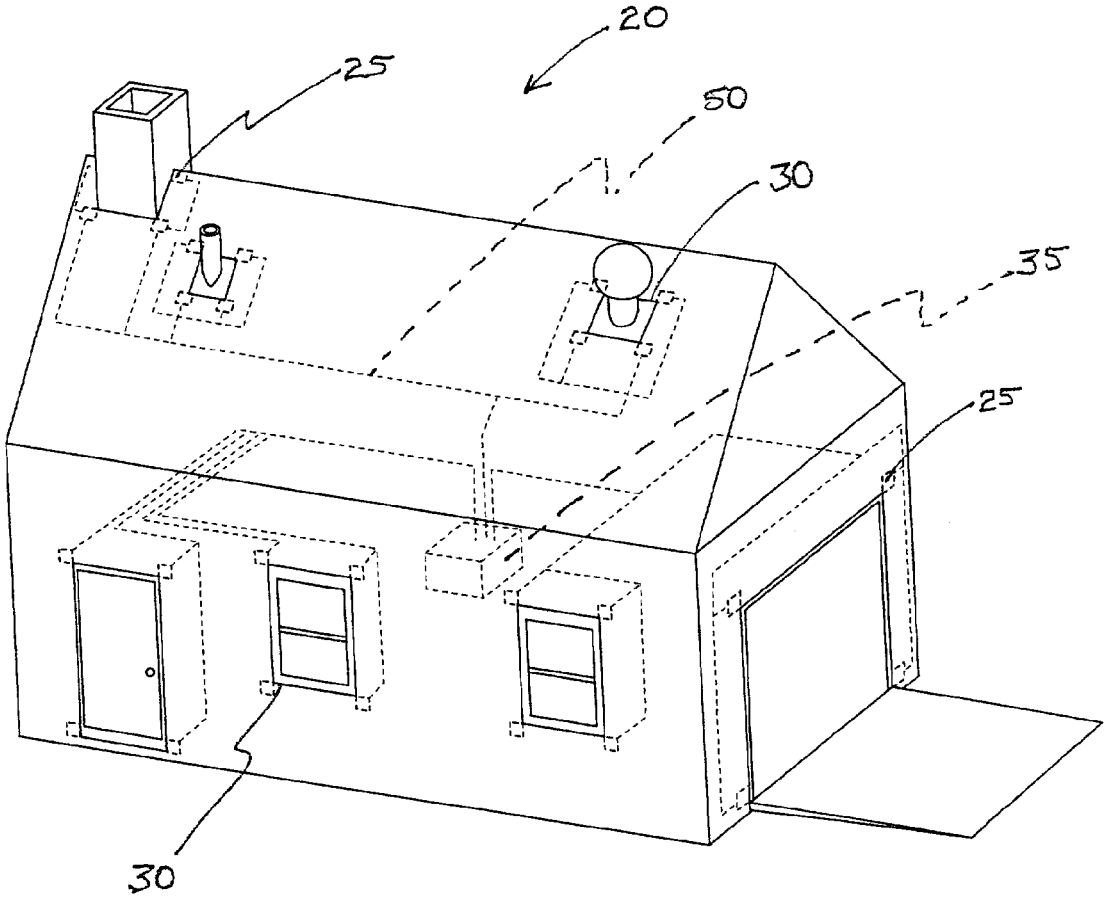
FIG. 8 is a perspective view of one embodiment of the invention in a residential housing structure.

As illustrated in FIG. 8, one embodiment of the system 20 herein may be used in a residential housing structure. In such an application, moisture sensors 25 may be positioned at junctions of chimney structures with roofing planes, garage doors, and the like. The moisture sensors 25 may have wired connections 50 with a receiver 35, such that the detection of moisture at a location 30 by a particular moisture sensor 25 will communicate a signal to the receiver 35 by means of the wired connections 50, so that the presence and location of moisture may be discerned.

Figure 9:
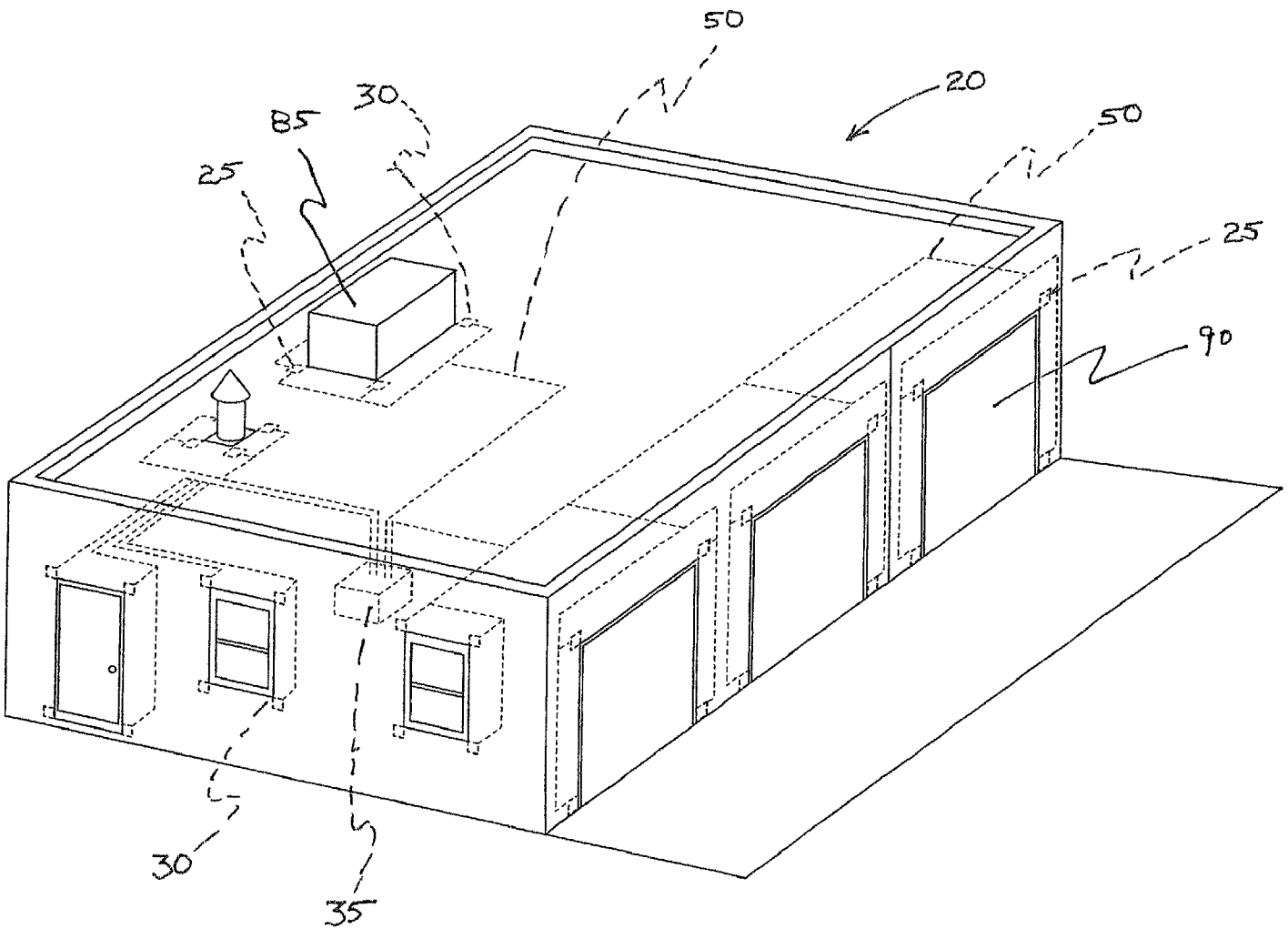
FIG. 9 is a perspective view of one embodiment of the invention in a commercial building structure.

Alternatively, as illustrated in FIG. 9, another embodiment of the system 20 herein may be used in a commercial building structure. In this application, moisture sensors 25 may be positioned at junctions of rooftop ventilation system units 85, loading bay doors 90, and other locations susceptible to moisture intrusion. Again, the moisture sensors 25 may have wired connections 50 with a receiver 35, such that the detection of moisture at a location 30 by a particular moisture sensor 25 will communicate a signal to the receiver 35 by means of the wired connections 50, revealing the presence and location of such moisture.

Figure 10A:
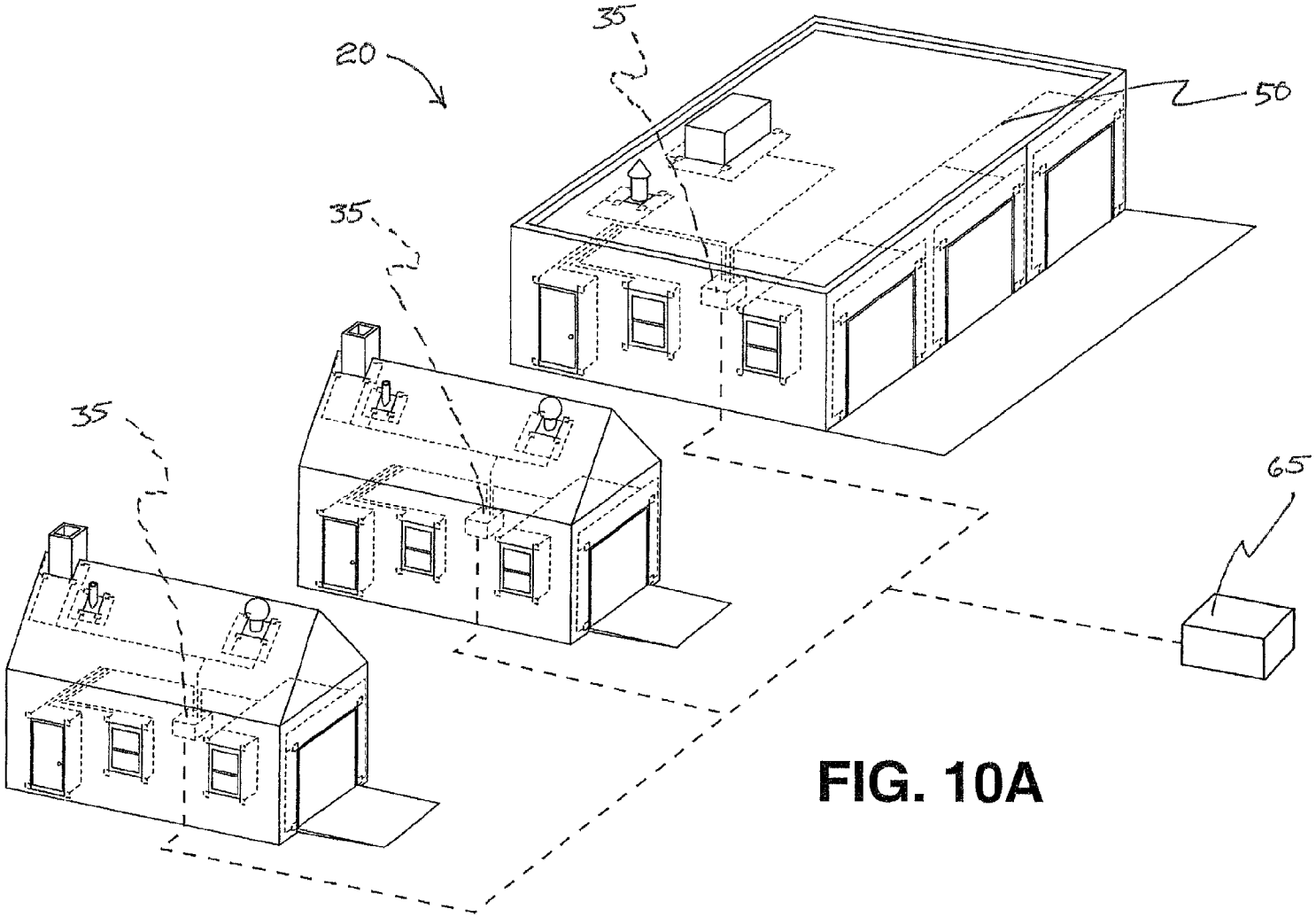
FIG. 10A is a perspective view of one embodiment of the invention in a plurality of structures, with wired communication to a central signal collector.
Figure 10B:
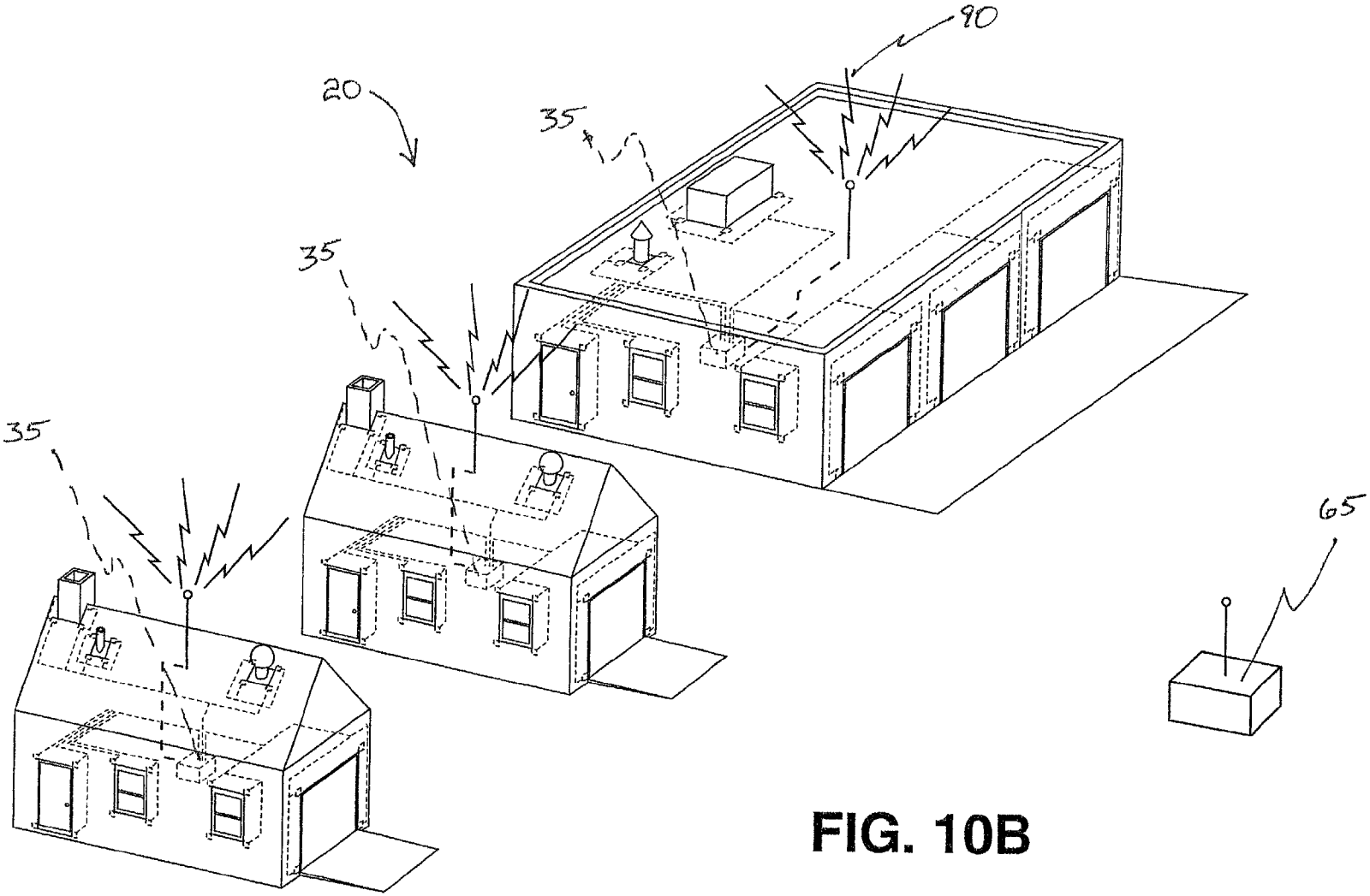
FIG. 10B is a perspective view of one embodiment of the invention in a plurality of structures, with wireless communication to a central signal collector.

As disclosed hereinabove, the system 20 may also be used with a plurality of structures, as is depicted in FIG. 10A as an example. In such example, several structures may be monitored at once, for example by a third-party service provider charged with such responsibility. In an embodiment as depicted in FIG. 10A, several structures would each include a plurality of moisture sensors 25, each in communication with a receiver 35. The receiver 35 may be within each structure to be monitored, as depicted in FIG. 10A, or may be within fewer than all of the structures (not depicted), or may be remote to all such structures. The receiver 35 may be in wired connection 50 with the moisture sensors 25, or may be in wireless communication with the moisture sensors 25 (not depicted). As further illustrated in FIGS. 10A and 10B, an application of system 20 may also include a central signal collector 65, in communication with receivers 35, for receipt of a signal indicating the presence of moisture at one or more locations 30 being monitored for moisture by moisture detectors 25 located within any of the plurality of buildings included within the system. As depicted in FIG. 10A, receivers 35 may be connected to the central signal collector 65 by wired connections; as depicted in FIG. 10*b*, such receivers may be in communication with central signal collector 65 by wireless communication 90.

Various modifications and combinations can be made in the embodiments of the present invention without departing from the scope and spirit of the invention. It is intended that the present invention includes such modifications and variations as come within the scope of the appended claims and their equivalents.

The invention claimed is:

1. A moisture detection and location system to monitor for the intrusion of moisture into the exterior cladding of a building at a plurality of separate locations, comprising:

a. a plurality of moisture sensors, said moisture sensors configured for installation proximate to components defining said exterior cladding of said building generally concealed from view;

b. each said moisture sensor including a pair of elongated electrically conductive leads, each said elongated electrically conductive leads defining an elongated length, said elongated lengths generally parallel to one another;

c. said elongated electrically conductive leads carried alone said lengths upon a pliable substrate, said pliable substrate defining a thickness adaptable for attachment between components defining said exterior cladding;

d. each said moisture sensor being activated upon the presence of moisture proximate to said leads along said lengths at its respective location and generating a corresponding signal upon activation thereof;

e. at least one receiver in communication with said plurality of moisture sensors to provide an identifier of the location of said respective activated moisture sensor.

2. The system as in claim 1, wherein said at least one receiver provides a visual identifier of the location of said respective activated moisture sensor.

3. The system as in claim 1, wherein said at least one receiver provides an audible identifier of the location of said respective activated moisture sensor.

4. The system as in claim 1, wherein said pliable substrate thickness is less than three sixteenths inch.

5. The system as in claim 1, wherein said pliable substrate thickness is less than one eighth inch.

6. The system as in claim 4, wherein said moisture sensors generate an audible signal upon activation by moisture.

7. The system as in claim 4, wherein said moisture sensors generate a visual signal upon activation by moisture.

8. The system as in claim 1, further comprising wire connections between each said moisture sensor and said at least one receiver.

9. The system as in claim 1, wherein said moisture sensors are in wireless communication with said at least one receiver.

10. The system as in claim 1, wherein said moisture sensors are carried at a plurality of different buildings.

11. A moisture detection and location system to monitor for the presence of moisture at a plurality of separate locations about a building envelope, comprising:

a. a plurality of moisture sensors, wherein said moisture sensors disposed at a plurality of locations within said building envelope interior to exterior building cladding;

b. each said moisture sensor including at least two elongated electrically conductive leads disposed relative to each other such that moisture proximate to said at least two elongated electrically conductive leads activates said moisture sensor by completing an electrical circuit;

c. at least one receiver in communication with said plurality of moisture sensors;

d. wherein upon moisture activating any of said moisture sensors, said respective moisture sensor generating a signal received by said at least one receiver, and said at least one receiver in turn generating an identifier of the location of the respective activated moisture sensor.

12. The system as in claim 11, wherein each said moisture sensor includes a pliable substrate carrying said leads, said pliable substrate conformable to structure upon which it is attachable at said locations.

13. The system as in claim 11, further comprising wire connections between each said moisture sensor and said at least one receiver.

14. The system as in claim 11, wherein said moisture sensors are in wireless communication with said at least one receiver.

15. The system as in claim 11, wherein said moisture sensors are carried at a plurality of different structures.

16. The system as in claim 15, further comprising:

a. at least one central signal collector, said at least one central signal collector in communication with said at least one receiver;

b. said at least one central signal collector being disposed remote to said at least one receiver;

c. wherein said central signal collector receives from said at least one receiver said identifier of the respective activated moisture sensor.

17. A structural system monitored for moisture, comprising:

a. a plurality of separate locations within an envelope of a structure to be monitored for moisture;

b. a moisture detection and location system to monitor for the presence of moisture at said separate locations, including i. a plurality of moisture sensors, wherein said moisture sensors disposed at a plurality of locations to be monitored;

ii. each said moisture sensor being activated upon the presence of moisture at its respective said location and generating a corresponding moisture signal upon activation thereof;

iii. at least one receiver in communication with said plurality of moisture sensors to receive said moisture signal; and iv. upon receipt of a said moisture signal, said at least one receiver providing an identifier of the location of the respective activated moisture sensor.

18. The system as in claim 17, comprising a single structure, said moisture sensors disposed at locations within said single structure.

19. The system as in claim 18, wherein said at least one receiver is disposed within said single structure.

20. The system as in claim 18, wherein said at least one receiver is disposed remote from said structure.

21. The system as in claim 17, further comprising:

a. a plurality of different structures;

b. said plurality of separate locations to be monitored for moisture disposed at said plurality of different structures;

c. said moisture sensors disposed in different ones of said structures.

22. The system as in claim 21, wherein said at least one receiver is disposed within one of said structures.

23. The system as in claim 21, wherein said receiver is disposed remote from said structures.

24. The system as in claim 17, wherein each said moisture sensor including at least two electrically conductive leads disposed relative to each other such that moisture proximate to said at least two electrically conductive leads completes an electrical circuit.

25. The system as in claim 24, wherein each said moisture sensor includes a pliable substrate carrying said leads, said pliable substrate conformable to structure upon which it is attachable at said locations.

26. The system as in claim 17, further comprising wire connections between each said moisture sensor and said at least one receiver.

27. The system as in claim 17, wherein said moisture sensors are in wireless communication with said at least one receiver.

28. The system as in claim 17, further comprising:

a. at least one central signal collector, said at least one central signal collector in communication with said at least one receiver;

b. said at least one central signal collector being disposed remote to said at least one receiver c. wherein said central signal collector receives from said at least one receiver said identifier of the respective activated moisture sensor.

29. A moisture detection and location system to monitor for the intrusion of moisture into the exterior cladding of a building at a plurality of separate locations, comprising:

a. a plurality of moisture sensing means, said moisture sensing means configured for installation proximate to components defining said exterior cladding of said building;

b. each said moisture sensing means being activated upon the presence of moisture at its respective location and generating a corresponding signal upon activation thereof;

c. at least one receiver in communication with said plurality of moisture sensing means to provide an identifier of the location of said respective activated moisture sensor.

30. A method of monitoring for the intrusion of moisture into the exterior cladding of a building, comprising the steps:

a. installing a plurality of moisture sensors at selected locations within the exterior cladding of a building proximate to penetrations through the exterior cladding;

b. configuring each said moisture sensor to be activated upon the presence of moisture at its respective location and to generate a corresponding signal upon activation thereof;

c. providing at least one receiver in communication with said plurality of moisture sensors to provide an identifier of the location of said respective activated moisture sensor.

* * * * *